US005586923A

United States Patent [19]

Hippely et al.

[11] Patent Number: 5,586,923

[45] Date of Patent: Dec. 24, 1996

[54] TOY VEHICLE PLAYSET FOR THERMOCHROMIC VEHICLES

[75] Inventors: Keith A. Hippely, Manhattan Beach; Larry R. Wood, Redondo Beach; Brian E. Walsh, Mission Hills; Terence A. Choy, Lawndale, all of Calif.

[73] Assignee: Mattel, Inc., El Segundo, Calif.

[21] Appl. No.: 388,224

[22] Filed: Feb. 9, 1995

[51] Int. Cl.[6] ..... A63H 33/00; A63H 3/00; A63H 3/52; A63H 18/00

[52] U.S. Cl. ..... 446/14; 446/74; 446/267; 446/444

[58] Field of Search ..... 446/14, 74, 75, 446/267, 423, 424, 429, 444, 476

[56] References Cited

U.S. PATENT DOCUMENTS

| | | | |
|---|---|---|---|
| 3,447,258 | 6/1969 | Moore . | |
| 3,456,596 | 7/1969 | Cooper . | |
| 3,542,366 | 11/1970 | Schecker . | |
| 4,146,991 | 4/1979 | Sano | 446/444 X |
| 4,221,073 | 9/1980 | Malczewski | 446/227 |
| 4,348,028 | 9/1982 | Barlow . | |
| 4,425,735 | 1/1984 | Kulesza et al. . | |
| 4,516,953 | 5/1985 | Hippely . | |
| 4,558,867 | 12/1985 | Hippely . | |
| 4,778,430 | 10/1988 | Goldfarb et al. . | |
| 4,961,716 | 10/1990 | Hippely et al. | 446/75 |
| 5,078,642 | 1/1992 | Glessner . | |
| 5,299,969 | 4/1994 | Zaruba . | |

FOREIGN PATENT DOCUMENTS

| | | | |
|---|---|---|---|
| 2092463 | 8/1982 | United Kingdom | 446/423 |

*Primary Examiner*—Robert A. Hafer
*Assistant Examiner*—D. Neal Muir
*Attorney, Agent, or Firm*—Roy A. Ekstrand

[57] ABSTRACT

A toy vehicle playset includes a trackway having a vehicle launcher coupled to a looped track portion and a dual tank unit positioned within the travel path of the toy vehicle through the trackway. The trackway further includes an exit ramp on the opposite side of the dual tank unit from the track loop which is coupled to a toy vehicle catcher and a display area. The dual tank unit includes a pair of tank portions separated by an intervening wall. The dual tank unit is supported within the trackway travel path such that either tank portion is alternatively positionable within the travel path of the toy vehicle. The playset further includes a multiply articulated robot arm supporting one or more thermally conductive tools or stamps which are immersible within the proximate one of the dual water tanks and appliable to the surface of the toy vehicle when resting in the toy vehicle catcher. The toy vehicle when launched down the trackway traverses the track loop and passes through the aligned one of the tank portions of the dual tank unit to receive a hot or cold water bath. The toy vehicle is at least partially covered with a thermochromic paint or coating and undergoes a thermochromic appearance change in the bath. Ideally, each of the tank portions is filled with a different temperature water supply.

13 Claims, 3 Drawing Sheets

TOY VEHICLE PLAYSET FOR THERMOCHROMIC VEHICLES

CROSS-REFERENCE TO RELATED APPLICATIONS

This application discloses apparatus described and claimed in copending application Ser. No. 08/387,047 (Attorney Docket 13600(2)) filed Feb. 10, 1995 on behalf of Hippely, et al. and entitled THERMOCHROMIC TOY VEHICLE PLAYSET HAVING ROBOT ARM DETAILER and copending application Ser. No. 08/387,049 (Attorney Docket 13600(3)) filed Feb. 10, 1995 on behalf of Hippely, et al. and entitled TOY VEHICLE PLAYSET HAVING VEHICLE RECEIVING AND HOLDING STATION which are assigned to the assignee of the present application.

1. Field of the Invention

This invention relates generally to toy vehicle playsets and particularly to those using thermochromic or color change toy vehicles.

2. Background of the Invention

Toy vehicle playsets have proven to be an extremely enduring and popular category of toys for a great many years. Not surprisingly, this long lasting and extensive popularity has given rise to a virtually endless variety of toy vehicle playsets. Thus, such playsets have been provided which use simple track structures and equally simple hand-rolled toy vehicles as well as more complex track structures utilizing toy vehicles which are powered or launched through the track playset. For example, a variety of toy vehicle playsets utilize a track having an elevated launching portion employing gravity and its effect upon the toy vehicle to provide a launching energy to traverse the track set. Other toy vehicle playsets have used spring-loaded or spring-powered launchers to provide the initial energy required to drive the toy vehicle through the track set. Still other toy vehicle playsets have utilized vehicles which themselves are powered using devices such as inertial drive motors, spring-driven wind-up motors, or electrical motors having battery or other electrical power sources. The variation has included a substantial divergence of the track structures themselves. The simpler track structures utilize a simple oval racetrack while others employ more complex apparatus such as inverting loop segments or jump and landing ramp segments which hurtle the toy vehicles through the air across an intervening gap.

Just as the track playsets have been subject to variation, the toy vehicles themselves have been similarly varied and diverse. Such toy vehicles are often realistic, bright colored and finely detailed. Others are less detailed, more fanciful and cartoon-like in character. Still other toy vehicles used in such playsets are configurable in alternative element arrangements to vary their appearance. One of the more interesting toy vehicle variations produced through the years employs so-called thermochromic material which is formed into a paint or coating upon the toy vehicles and which provides a change in color in response to temperature changes. Such toy vehicles often referred to "color-change" toy vehicles have provided an interesting and amusing variation for toy designers to utilize in their endless task of providing amusing and entertaining as well as novel toy playsets.

Thus, practitioners continue to respond to the popularity of such toy vehicle playsets to improve the amusement, entertainment and novelty thereof. For example, U.S. Pat. No. 4,558,867 issued to Hippely sets forth a TOY VEHICLE TRACKWAY SET having a base member defining a circular ramp, a vehicle loop, a straight track segment and a vehicle receiving neck. A toy vehicle is launched down the straight track segment and in succession traverses a vertical loop and a horizontal circular ramp to be thereafter launched through the air and directed toward the vehicle receiving neck.

U.S. Pat. No. 4,516,953 issued to Hippely, et al. sets forth a TOY VEHICLE PLAYSET having a transparent hollow member with opposed open ends. A toy vehicle track is formed integrally with the inner surface of the hollow member and spirals from open end to the other. Each open end is coupled to a straight track segment. Toy vehicles are launched into the transparent hollow member via one of the open end track segments and thereafter traverse the interior spiral path of the hollow member to emerge at the opposite open end.

U.S. Pat. No. 4,425,735 issued to Kluesza, et al. sets forth a TOY VEHICLE DEVICE having a toy vehicle and vehicle track in the form of a belt forming a buckle which releasibly retains the vehicle on an outwardly facing surface thereof. The buckle further includes a propulsion mechanism for propelling the vehicle from the buckle along the length of an upwardly facing surface of the belt.

U.S. Pat. No. 3,542,366 issued to Schecker sets forth a COMBINATION WHEELED VEHICLE SLOPING TRACK, LOOP AND SCORING MAT having an elongated track together with a raised launching platform which receives a toy vehicle and which allows the toy vehicle to traverse a downwardly inclined ramp formed in the track. The track further forms a loop segment and is directed to a scoring mat.

U.S. Pat. No. 4,778,430 issued to Goldfarb, et al. sets forth a WATER SLIDE TOY having a downwardly inclined slide having an upper end and a lower end. A carrier is formed on the slide for raising discrete objects such as human or animal figures from the lower end to the upper end. A spiral ramp extends downwardly from the upper end and ultimately returns to the lower end of the ramp.

U.S. Pat. No. 5,299,969 issued to Zaruba sets forth a LOOP FEATURE FOR PROPELLED TOY VEHICLES having a track forming a vertically oriented loop defining a movable ingress portion and a movable egress portion. A propelled toy vehicle enters the loop portion through the ingress portion, traverses the loop and exits the loop through the egress portion.

U.S. Pat. No. 3,447,258 issued to Moore sets forth a MODEL WATER RACING TOY having an oval trackway for receiving a quantity of water together with means for guiding and propelling boats therethrough.

U.S. Pat. No. 3,456,596 issued to Cooper sets forth a WATER HAZARD ACCESSORY TRACK UNIT having a trackway forming a general Y-intersection and having an alternative switching mechanism for directing a toy vehicle through alternate branches of the Y. The intersection is surrounded by a raised wall which facilitates the addition of a quantity of water to the intersection presenting a water hazard.

U.S. Pat. No. 4,348,028 issued to Barlow sets forth a BOARD GAME WITH RANDOM WATER DISTRIBUTION FOR DUNKING, PLAYING PIECES having a raised supporting tower which in turn supports a downwardly spiraled series of water troughs. Playing pieces may be moved from a starting point to a finish point and are subjected to a dunking process.

U.S. No. 5,078,642 issued to Glessner sets forth a TOY BAR SOAP SLIDE having a walled trackway including a loop segment and an inclined ramp segment which receives and slides a bar of wetted soap within a bathtub environment.

While the foregoing described prior art devices have provided improvement in the art and, in some instances have enjoyed commercial success, there remains nonetheless a continuing need in the art for evermore improved interesting and varied toy vehicle playsets and accessories for use in combination therewith.

SUMMARY OF THE INVENTION

Accordingly, it is a general object of the present invention to provide an improved toy vehicle playset. It is a more particular object of the present invention to provide an improved toy vehicle playset for use in combination with thermochromic toy vehicles. It is a still more particular object of the present invention to provide an improved toy vehicle playset for use with thermochromic toy vehicles which facilitates the color change as part of the play pattern.

In accordance with the present invention, there is provided for use in combination with a toy vehicle having at least a portion thereof bearing a thermochromic material, a toy vehicle playset comprising: a trackway for guiding a toy vehicle along a travel path; a tank unit having at least two tank portions each having a ramp passing therethrough; and a base supporting the tank unit having means for aligning a selected one of the at least two tank portions within the travel path, the tank portions receiving quantities of different temperature liquid such that the toy vehicle traversing the travel path is exposed to the liquid within the aligned one of the tank portions.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENT

Figure 1:
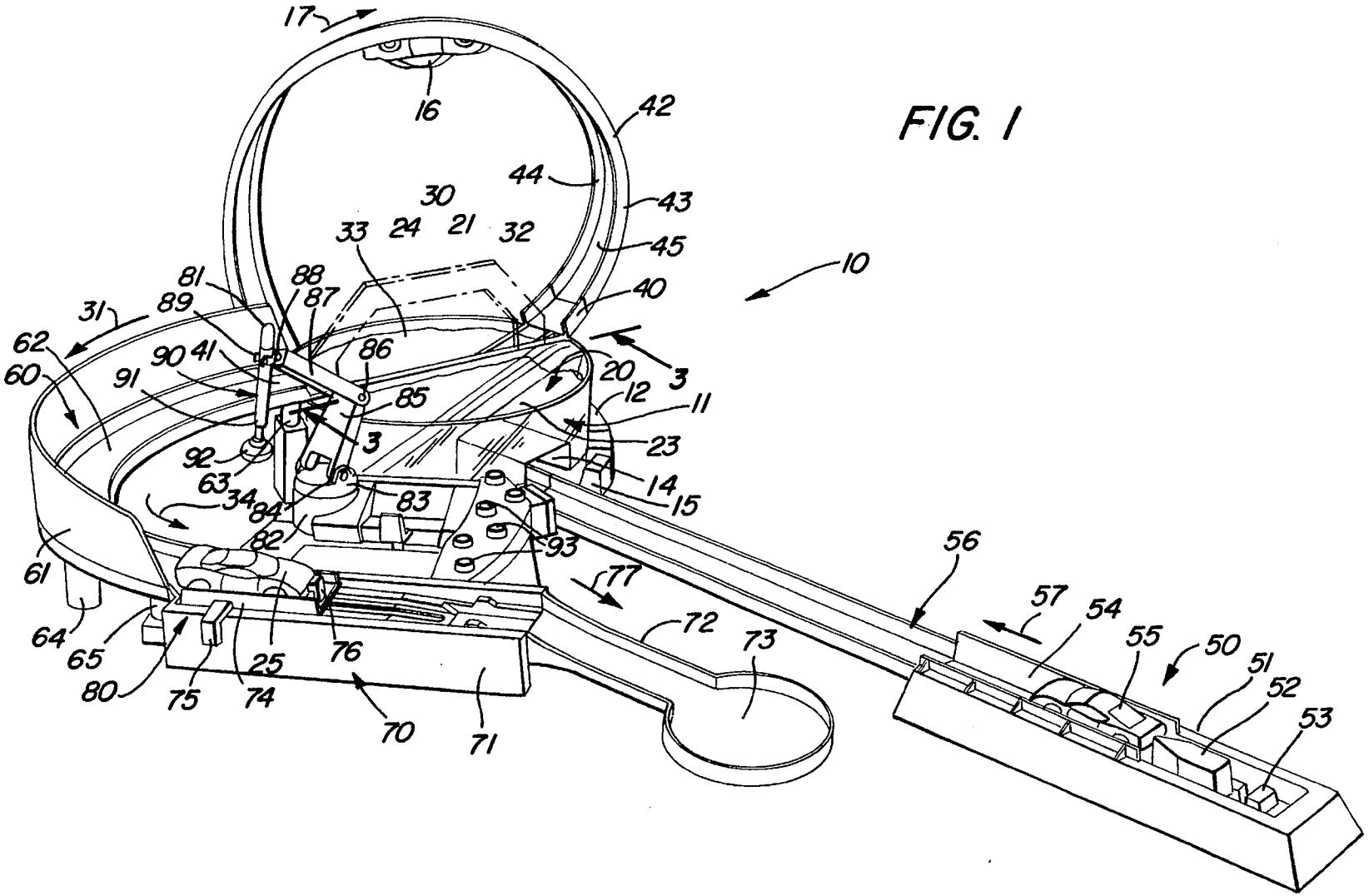
FIG. 1 sets forth a perspective view of a toy vehicle playset constructed in accordance with the present invention.

FIG. 1 sets forth a perspective view of a toy vehicle playset constructed in accordance with the present invention and generally referenced by numeral 10. Playset 10 includes a dual tank unit 11 supported by a base 12 and having a pair of tank portions 20 and 30 separated by a wall 21. Base 12 further defines an opening 15 which is coupled to and receives a straight track segment 56. A vehicle launcher 50 constructed in accordance with conventional fabrication techniques is coupled to track segment 56 and includes a housing 51 supporting a movable spring-loaded pusher 52 and a trigger latch 53. Vehicle launcher 50 further includes a staging area 54 which is shown receiving a vehicle 55 in the to-be-launched position.

Base 12 further supports an entrance gate 40 and an exit gate 41 in alignment on a common side of wall 21 of dual tank unit 11. A track loop 42 having a pair of sidewalls 43 and 44 on each side of a trackway 45 is coupled at one end to entrance gate 40 and forms a vertical loop extending downwardly into alignment with track segment 56 on the opposite side of opening 15 in base 12. Tank 20 defines a dipped ramp 22 alongside one side of wall 21 while tank 30 defines a similar dipped ramp 32 on the opposite side of wall 21. Tanks 20 and 30 support quantities of water 23 and 33 respectively which in accordance with the present invention differ substantially in temperature. Dual tank unit 11 further includes an upwardly extending handle 24 and a tunnel 14 which extends beneath tanks 20 and 30 and emerges on the opposite side of the dual tank unit in alignment with the remaining end of track loop 42.

Playset 10 further includes a curved ramp 60 having a raised outer sidewall 61 and a trackway 62. Trackway 62 extends from exit gate 41 in a downwardly curved path. Ramp 60 is supported by a plurality of supports 63, 64 and 65. Playset 10 further includes a toy vehicle catcher 70 having an elongated housing 71 which receives and supports a movable shuttle 74. Shuttle 74 includes a tab 75 extending outwardly therefrom and a vehicle stop mechanism 76 at the frontal portion thereof. Toy vehicle catcher 70 further includes a downwardly extending ramp 72 terminating in a display area 73. In the position shown in FIG. 1, shuttle 74 has received and captured a toy vehicle 25 following the toy vehicle's travel down trackway 62. This position shown in FIG. 1 provides a vehicle detail area 80 in which the toy vehicle may be further enhanced in its appearance.

Toy vehicle playset 10 further includes a robot arm 81 having a support base 82 upon which a rotatable platform 83 is secured. Platform 83 includes a pivot 84 securing a support arm 85 at the lower end thereof. An arm 87 is pivotally coupled to the upper end of arm 85 by a pivotal attachment 86. A swivel joint 88 supports a clasp 89 in a pivotal attachment at the upper end of arm 87. A stamp 90 includes an elongated handle 91 received within clasp 89 supporting a thermally conductive stamper 92 at the lower end thereof. Stamper 92 is preferably formed of a thermally conductive material and defines an embossed design producing member. Toy vehicle catcher 70 further defines a plurality of tool receptacles 93 which receive and support a plurality of alternative tools generally configured in the manner shown for stamp 90 and having elongated handles such as handle 91 which are receivable within receptacles 93 for convenient access and storage.

In operation, dual tank unit 11 is initially filled with quantities of water 23 and 33 within tanks 20 and 30 having substantial temperature differences. Thus, for example, tank 20 may be filled with hot water while tank 30 is filled with cold water. Dual tank unit 11 is positioned such that tunnel 14 is aligned with opening 15 of base 12 and track segment 56. Thereafter, a toy vehicle such as vehicle 55 is placed within launcher 50 which in turn is cocked to permit the launching of vehicle 55. In the preferred play pattern of the present invention, vehicle 55 comprises a toy vehicle having at least certain portions coated or painted with a color change or thermochromic material. In the present example, water 23 within tank 20 is hot while water 33 within tank 30 is cold. Ice cubes may be placed in tank 30 to help keep the water cold during extended play. Accordingly, as shown in FIG. 1, the preferred effect of the present invention playset is provided if vehicle 55 is subjected to a hot water bath and dried prior to placement within vehicle launcher 50. This is because the position of dual tank unit 11 in the present example of FIG. 1 aligns tank 30 having cold water therein with track loop 42 and ramp 60.

With vehicle 55 thus configured and positioned within vehicle launcher 50, the user then pushes trigger 53 causing vehicle 55 to be launched in the direction of arrow 57 from launcher 50 in a conventional vehicle launching operation. Vehicle 55 then travels in the direction of arrow 57 along track segment 56 and through opening 15 into tunnel 14. The toy vehicle continues through tunnel 14 emerging on the opposite side of dual tank unit 11 and traveling beneath tanks 20 and 30 to enter the lower end of track loop 42. Thereafter, the kinetic energy of the toy vehicle causes it to traverse track loop 42 in the direction indicated by arrow 17. For purposes of illustration, a toy vehicle 16 is shown at the midpoint of traversing track loop 42. The toy vehicle then continues traveling downwardly upon the remaining portion of track loop 42 through entrance gate 40 and into tank 30. As the toy vehicle traverses ramp 32 through tank 30, it is subjected to the cold water within tank 30 and undergoes a temperature change. The kinetic energy of the toy vehicle carries it upwardly upon the remaining portion of ramp 32 through exit gate 41 and onto trackway 62 of ramp 60 in the direction indicated by arrow 31. In the example of FIG. 1, the toy vehicle when subjected to the cold water within tank 30 undergoes a sufficient temperature change to change the thermochromic coating material thereof and produce a color change. Because of the speed of the vehicle along the track, the vehicle travels through the water in only a fraction of a second, and correspondingly, changes color in only a fraction of a second. The resultant color change appears to be instantaneous, which is a unique and entertaining effect that enhances play value. The color change vehicle traverses trackway 62 and enters shuttle 74 of toy vehicle 70. The travel of the toy vehicle is stopped in the position shown by vehicle 25 through the action of stop 76.

The color changed toy vehicle now resting within shuttle 74 has assumed the color change configuration which results from cold water immersion within tank 30. At this point, the toy vehicle may be further enhanced or detailed through the use of robot arm 81 while supported within detail area 80 as shown in FIG. 1. Robot arm 81 is pivotally movable about base 82 as platform 83 rotates. In its preferred use, robot arm 81 is pivoted to extend arm 87 above tank 20 and permit stamper 92 of stamp 90 to be immersed into the hot water within tank 20 by suitable pivoting swivel joint 88, pivot 86, and pivot 84. Stamper 92 is warmed within the hot water of tank 20 and thereafter is withdrawn from water 23 by manipulation of robot arm 81. Robot arm 81 is further manipulated to position stamper 92 of stamp 90 in proximity to vehicle 25 and thereafter bring stamper 92 against a selected area of vehicle 25. As mentioned above, vehicle 25 having traversed the cold water bath of tank 30 has assumed the thermochromic characteristic of lower temperature. The warming action of stamper 92 against the cold temperature configurated vehicle causes a localized thermochromic characteristic change on the portions of vehicle 25 contacted by stamper 92 due to its warm temperature received from the warm water of tank 20. Robot arm 81 is thereafter manipulated to move stamper 92 away from toy vehicle 25 with the result that vehicle 25 now has a thermochromically imparted image corresponding to stamper 92. This process may be repeated with robot arm 81 moving stamper 92 between the hot water of tank 20 and the cold temperature configured surface of vehicle 25. If desired, a small tissue paper or absorbent material may be used to blot the warm water from stamper 92 following its immersion within tank 20.

Once the desired images have been formed upon vehicle 25, the user then moves vehicle 25 by sliding tab 75 toward ramp 72 across toy vehicle catcher 70. Once shuttle 74 reaches ramp 72, stop 76 is released and the toy vehicle is moved onto ramp 72 and descends downwardly into display area 73 where it remains until removed by the user.

Dual tank unit 11 is reversible in its position by simply raising dual tank unit 11 slightly grasping handle 24 and thereafter rotating dual tank unit 11 one hundred eighty degrees and then lowering dual tank unit 11 back into the seated position upon base 12. The reversal or one hundred eighty degree rotation of dual tank unit 11 switches the relative positions of tanks 20 and 30 from that shown in FIG. 1. As a result of such rotation or tank switching, the travel path of the toy vehicle passes through the hot water of tank 20 while the cold water of tank 30 is positioned in proximity to robot arm 81. Thus, the relative positions of tanks 20 and 30 and robot arm 81 assure that robot arm 81 is always subjecting the stamp or tool which it supports to a temperature opposite from that to which the toy vehicle has been most recently exposed as it travels the trackway and comes to rest in detail area 80.

Figure 2:
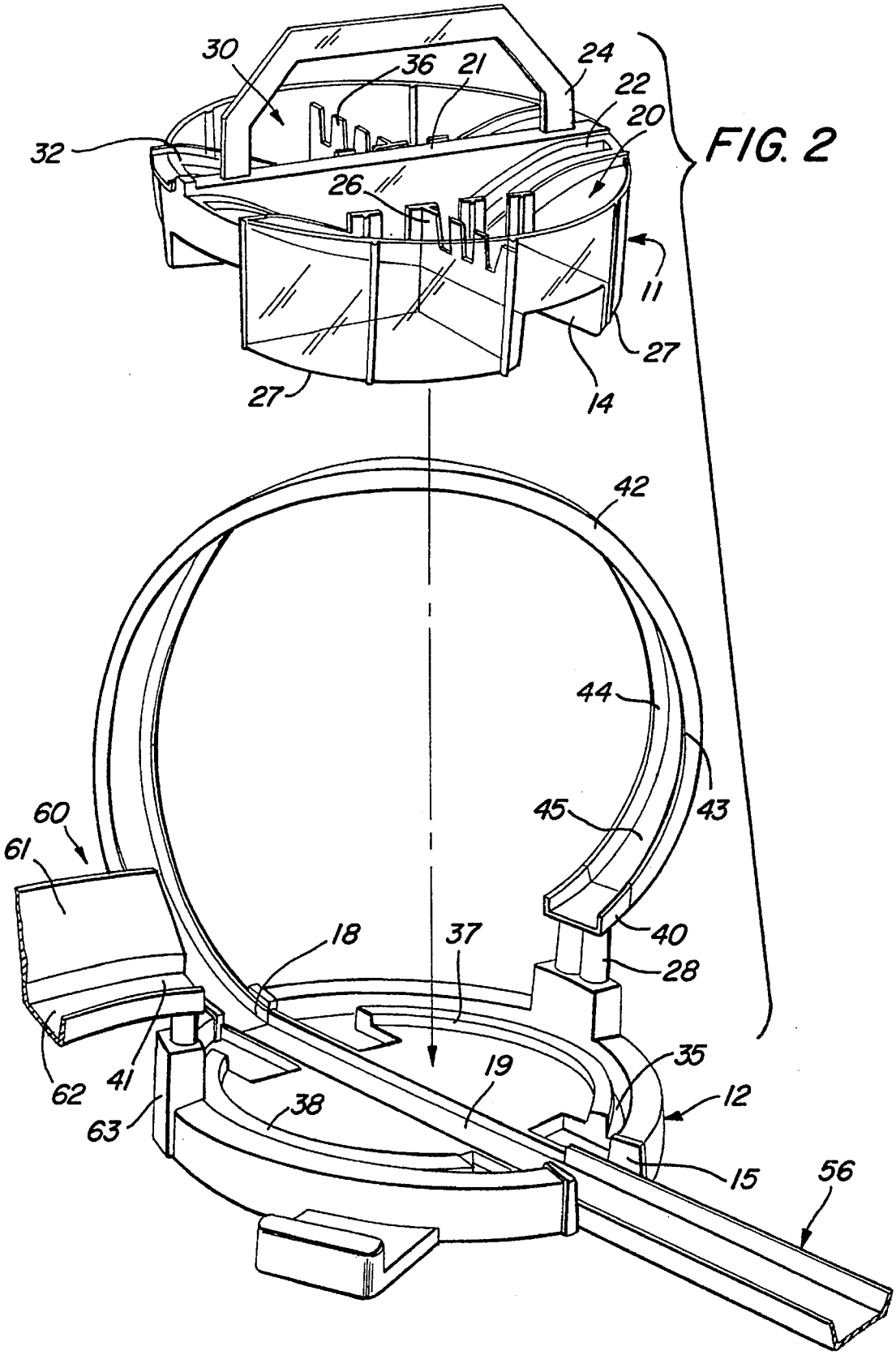
FIG. 2 sets forth a perspective assembly view of the dual tank portion of the present invention toy vehicle playset.

FIG. 2 sets forth a perspective assembly view of the dual tank assembly of the present invention toy playset. As described above, toy playset 10 includes a generally circular base 12 having an opening 15 formed on one side thereof and an opening 18 formed on the diametrically opposed side thereof. A trackway 19 extends between openings 15 and 18. Base 12 further defines an annular groove 35 extending on either side of openings 15 and 18 and a pair of vertically extending supports 28 and 63. Support 28 supports an entrance gate 40 while support 63 is coupled to exit gate 41 of ramp 60. As described above, ramp 60 includes a trackway 62 extending from exit gate 41 and a wall 61 on the outer edge thereof. A straight segment 56 is coupled to opening 15 while opening 18 is coupled to the lower end of a generally vertical track loop 42. The remaining end of track loop 42 is coupled to entrance gate 40 using conventional attachment means (not shown). Track loop 42 includes a trackway 45 having a pair of sidewalls 43 and 44 on each side thereof.

A dual tank unit 11 defines a generally cylindrical member having a circular lower edge 27 and forming a tunnel 14 extending diametrically therethrough. Dual tank unit 11 further includes a wall 21 separating the interior of dual tank unit 11 into a pair of semicircular shaped tanks 20 and 30. Tank 20 supports a plurality of baffles 26 and a generally U-shaped ramp 22. Similarly, tank 30 includes a plurality of baffles 36 and a substantially U-shaped ramp 32. Ramps 22 and 32 extend downwardly into and rise from tanks 20 and 30 and are generally adjacent to and parallel to wall 21. A handle 24 extends upwardly from wall 21 and defines a generally inverted U-shape.

With track loop 42 assembled to base 12 in the manner shown and with track segment 56 secured within opening 15, dual tank unit 11 is positioned upon base 12 such that lower edge 27 thereof is received within groove 35. Dual tank unit 11 is positioned such that tunnel 14 overlies and is parallel to trackway 19 of base 12. Dual tank unit 11 is alternatively positionable upon base 12 such that tank 20 overlies opening 15 and tank 30 overlies opening 18 or alternatively in a reversed position such that tank 30 overlies opening 15 and tank 20 overlies opening 18. In both positions, tunnel 14 generally overlies and is parallel to trackway 19. The difference between alternate positions of dual tank unit 11 upon base 12 is the relative positions of tanks 20 and 30 with respect to entrance gate 40 and exit gate 41 as well as proximity to robot arm 81 (seen in FIG. 1). Thus, as described above, the alternative positions of dual tank unit 11 provide for the positioning of hot and cold baths within tanks 20 and 30 as desired for cooperation with the thermochromic characteristic of the toy vehicles used with the present invention toy playset. In the preferred form of the present invention, interior walls 37 and 38 on each side of trackway 19 cooperate with the under structure (not shown) of dual tank unit 11 to provide a "nesting" of dual tank unit 11 in either of the alternate positions described above.

Figure 3:
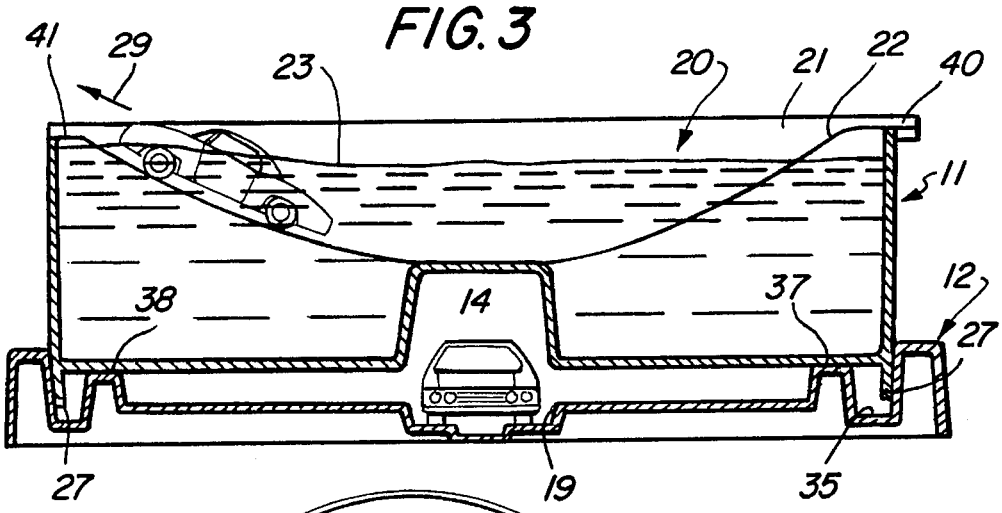
FIG. 3 sets forth a section view of the tank portion of the present invention toy vehicle playset taken along section lines 3—3 in FIG. 1.

FIG. 3 sets forth a section view of the dual tank unit of the present invention taken along section lines 3—3 in FIG. 1. Dual tank unit 11 supports a generally U-shaped ramp 22 extending between an entrance gate 40 and an exit gate 41. Ramp 22 is sufficient in depth to permit a toy vehicle traversing ramp 22 from entrance gate 40 to exit gate 41 in the direction of arrow 29 to be completely immersed in a quantity of water 23 supported within tank 20. A tunnel 14 extends through and beneath tank 20 and is generally transverse to wall 21 and ramp 22. A base 12 supports dual tank unit 11 and receives lower edge 27 thereof. A groove 35 formed within base 12 receives lower edge 27 of dual tank unit 11. A pair of arcuate wall segments 37 and 38 are positioned on the interior side of groove 35 and provide additional support for dual unit 11. Base 12 further defines a trackway 19 extending beneath tunnel 14. Tunnel 14 and trackway 19 cooperate to provide a passage through which a toy vehicle is able to pass beneath tanks 20 and 30 (the latter seen in FIG. 2) in the above-described playset operation.

Figure 4:
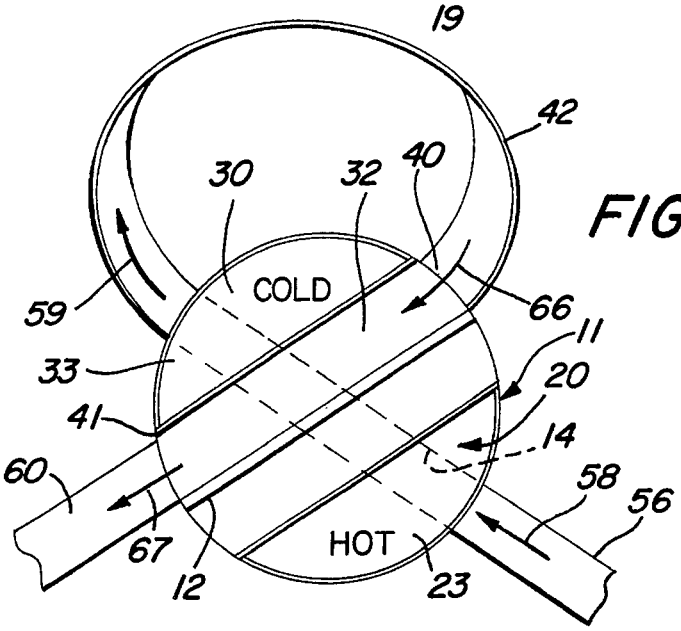
FIG. 4 sets forth a top view of the tank portion of the present invention toy vehicle playset.

FIG. 4 sets forth a simplified top view of dual tank unit 11 together with the surrounding track portions of the present invention toy playset. Dual tank unit 11 includes a pair of tanks 20 and 30 having ramps 22 and 32 respectively formed therein. Tanks 20 and 30 are separated by an interior wall 21. A tunnel extends beneath tanks 20 and 30 and is generally transverse to wall 21. A track segment 56 is aligned with one side of tunnel 14 while a track loop 42 is supported in alignment with the opposed side of tunnel 14 at one end and is coupled to an entrance gate 40 at the remaining end. A ramp 60 is aligned with exit gate 41 on the opposite side of dual tank unit 11 from entrance gate 40.

In operation, a toy vehicle is accelerated beneath dual tank unit 11 through a track segment 56 in the direction indicated by arrow 58. The accelerated toy vehicle enters track loop 42 in the direction indicated by arrow 59 and traverses the loop to enter ramp 32 of tank 30 in the direction indicated by arrow 66. The kinetic energy of the toy vehicle drives the toy vehicle through the liquid bath within tank 30 emerging at exit gate 41 in the direction indicated by arrow 67. Thereafter, the toy vehicle continues to travel upon ramp 60 in the manner described above. In the position shown in FIG. 4, tank 30 is filled with a quantity of cold water and is aligned with gates 40 and 41. Conversely, tank 20 is filled with a quantity of hot water and is positioned out of alignment with gates 40 and 41.

It should be noted that the perspective view of FIG. 4 somewhat distorts the appearance of the relative angle between tunnel 14 and ramps 22 and 32 and wall 21 of dual tank unit 11. In reality, tunnel 14 is preferably formed perpendicular to wall 21 and ramps 22 and 32 to facilitate the alignment of tunnel 14 with track segment 56 and track loop 42 in each alternative position of dual tank unit 11. Thus, in accordance with an important aspect of the present invention, dual tank unit 11 may be rotated from the position shown in FIG. 4 to an alternative position in which ramp 22 of tank 20 is aligned with gates 40 and 41 and in which tank 30 is positioned out of alignment with gates 40 and 41. In other words, dual tank unit 11 is rotatable one hundred eighty degrees to switch the positions of tanks 20 and 30. In so doing, the temperature bath to which the toy vehicle is subjected as it traverses the dual tank unit is reversed. The cold water bath of tank 30 is replaced in such case by the hot water bath of tank 20.

Figure 5:
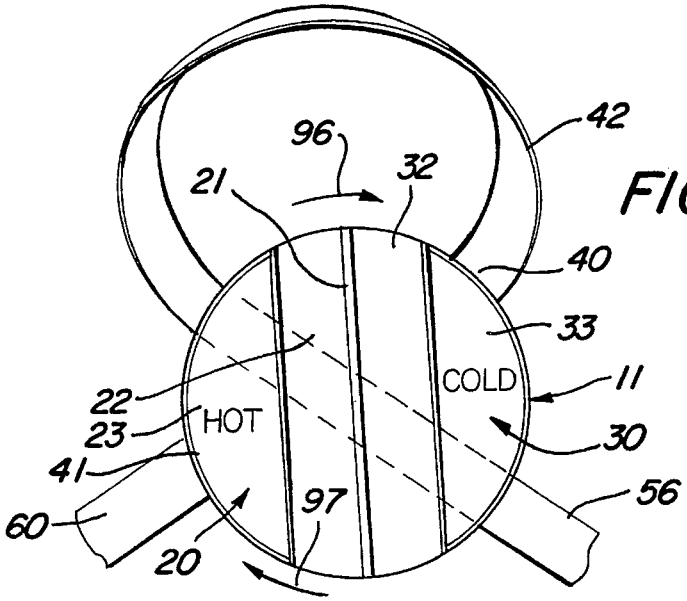
FIG. 5 sets forth a top view of the tank portion of the present invention toy vehicle playset during tank rotation.

FIG. 5 sets forth the simplified perspective view of FIG. 4 during the rotation of dual tank unit 11. Dual tank 11 having been raised slightly is rotated in the direction indicated by arrows 96 and 97 with the objective of moving tank 30 out of alignment with gates 40 and 41 and moving tank 20 into alignment. It will be apparent to those skilled in the art that this rotation of dual tank unit 11 may be carried forward a repeated number of times and may be accomplished by rotating dual tank unit 11 in either direction.

What has been shown is a toy vehicle playset for thermochromic vehicles which utilizes a dual tank for maintaining hot and cold water baths alternatively in alignment with the travel path of the toy vehicle. The reversal of position of the rotatable dual tank unit alternates the hot or cold relative temperature to which the toy vehicle is subjected.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. For use in combination with a toy vehicle having at least a portion thereof bearing a thermochromic material, a toy vehicle playset comprising:

a trackway for guiding a toy vehicle along a travel path having an entrance gate and an exit gate.;

a tank unit having at least two tank portions each having a ramp passing therethrough; and a base supporting said tank unit between said entrance gate and said exit gate having means for aligning a selected one of said ramps within a selected one of said at least two tank portions within said travel path, said at least two tank portions each receiving quantities of different temperature liquid such that said toy vehicle traversing said selected one of said ramps is exposed to the liquid within said selected one of said at least two tank portions.

2. A toy vehicle playset as set forth in claim 1 wherein said tank unit is rotatable with respect to said base.

3. A toy vehicle playset as set forth in claim 2 wherein said trackway includes a track portion passing beneath said tank unit.

4. A toy vehicle playset as set forth in claim 3 wherein said tank unit includes a dividing wall separating said at least two tank portions.

5. A toy vehicle playset as set forth in claim 4 wherein said ramps of said at least two tank portions are generally parallel to said dividing wall and positioned on opposite sides thereof.

6. A toy vehicle playset as set forth in claim 5 wherein said trackway includes a generally vertical loop having one end aligned with said track portion passing beneath said tank unit and another end aligned with one of said ramps.

7. A toy vehicle playset as set forth in claim 6 wherein said tank unit defines a tunnel generally orthogonal to said dividing wall overlying said track portion passing beneath said tank unit.

8. A toy vehicle playset comprising:

a dual tank unit defining a generally cylindrical shape and having a wall forming a pair of tank portions each having a generally U-shaped ramp parallel to said wall;

a trackway for guiding a toy vehicle along a travel path having an entrance gate and a spaced apart exit gate; and a base for supporting said dual tank unit between said entrance gate and said exit gate such that either of said ramps is alternatively aligned with said entrance gate and said exit gate.

9. A toy vehicle playset as set forth in claim 8 wherein said trackway includes a portion passing beneath said dual tank unit.

10. A toy vehicle playset as set forth in claim 9 wherein said tank portions are generally semicylindrical.

11. A toy vehicle playset comprising:

a dual tank unit having first and second separated liquid-receiving tank portions having first and second generally U-shaped ramps extending therethrough;

a base for supporting said dual tank unit in first and second alternative positions separated by approximately one hundred eighty degrees; and a trackway having a first portion having a first end aligned with said first ramp and a second portion having a second end aligned with said first ramp such that a toy vehicle traveling said trackway traverses said first portion, said first ramp and said second portion and is at least partially immersed in liquid within said first tank portion when said tank unit is in said first position, said dual tank unit being movable to said second alternative position to align said second ramp with said first and second ends of said first and second trackway portions such that a toy vehicle traveling said trackway traverses said first portion, said second ramp and said second portion and is at least partially immersed in liquid within said second tank portion.

12. For use in combination with a toy vehicle having a thermochromic portion, a toy vehicle playset comprising:

a dual tank unit having a pair of liquid supporting tanks each having a ramp portion therethrough;

a base having an entrance gate and an exit gate for supporting said dual tank unit between said entrance gate and exit gate such that either of said liquid supporting tanks may be interposed between said entrance gate and said exit gate so as to align its respective ramp portion therebetween; and a trackway including a first track segment coupled to said entrance gate.

13. A toy vehicle playset as set forth in claim 12 wherein said trackway includes a second track segment coupled to said exit gate.

* * * * *